United States Patent [19]

Governale

[11] Patent Number: 4,475,313

[45] Date of Patent: Oct. 9, 1984

[54] LOCKING ARRANGEMENT FOR SLIDING DOORS

[75] Inventor: Bernard C. Governale, Duluth, Ga.

[73] Assignee: Peachtree Doors, Inc., Norcross, Ga.

[21] Appl. No.: 482,255

[22] Filed: Apr. 5, 1983

[51] Int. Cl.[3] ..... E06B 3/42

[52] U.S. Cl. ..... 49/370; 49/449; 292/DIG. 39; 292/DIG. 46; 292/101; 292/42

[58] Field of Search ..... 49/370, 449, 458; 292/DIG. 39, 42, DIG. 55, DIG. 46, 111, 101

[56] References Cited

U.S. PATENT DOCUMENTS

| | | | |
|---|---|---|---|
| 3,048,435 | 8/1962 | DeMarco | 292/111 |
| 3,774,342 | 11/1973 | Thom | 49/370 X |
| 3,870,353 | 3/1975 | Miller | 292/DIG. 46 X |
| 3,877,739 | 4/1975 | Cowen | 292/DIG. 46 X |
| 4,315,648 | 2/1982 | Labelle | 49/449 X |

*Primary Examiner*—Philip C. Kannan
*Attorney, Agent, or Firm*—D. Paul Weaver

[57] ABSTRACT

Sliding doors of increased strength, stability and resistance to the elements include on the normally inactive sliding door panel top and bottom vertical axis locking bolts which engage in apertures at the top of the door frame and sill. An intermediate level swinging bolt on the active sliding door panel is used in conjunction with an adjacent anti-lift tab also on the active sliding door panel. This tab and the locking extension of the swinging bolt are received in apertures formed in the adjacent stile of the inactive door panel to achieve secure locking of the sliding panels in closed positions. All of the bolts of the system are disposed within the opposing interfitting vertical stiles of the active and inactive sliding panels adjacent to tongue and groove portions thereof. The locking arrangement can be utilized on sliding door systems containing four or more panels.

5 Claims, 8 Drawing Figures

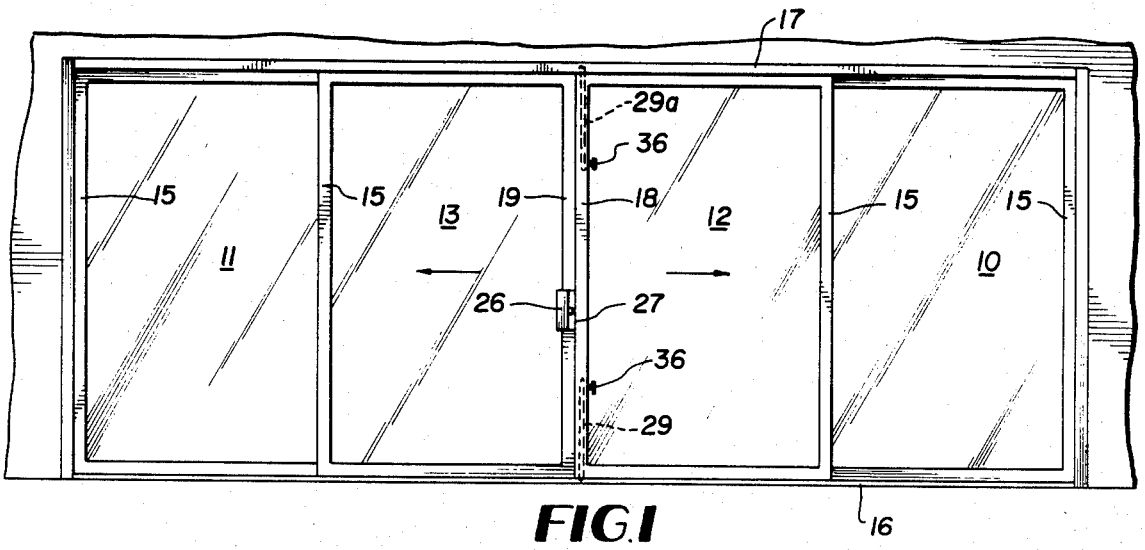
FIG. 1
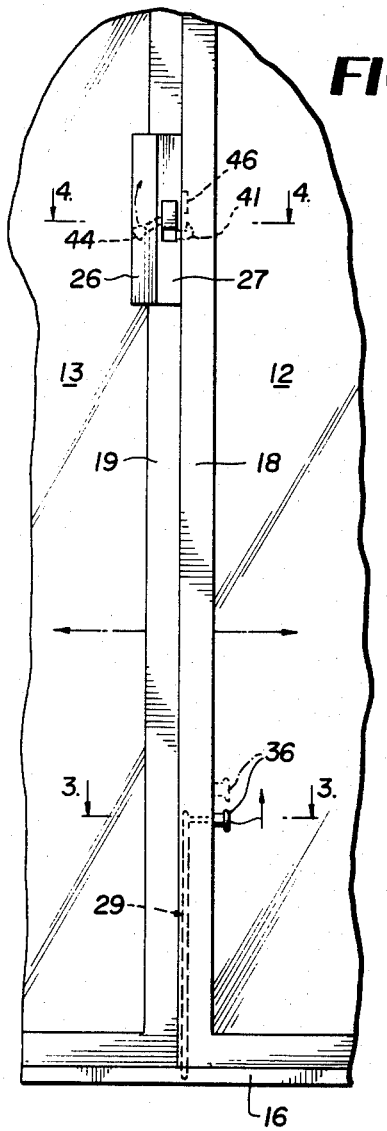
FIG. 2
FIG. 3
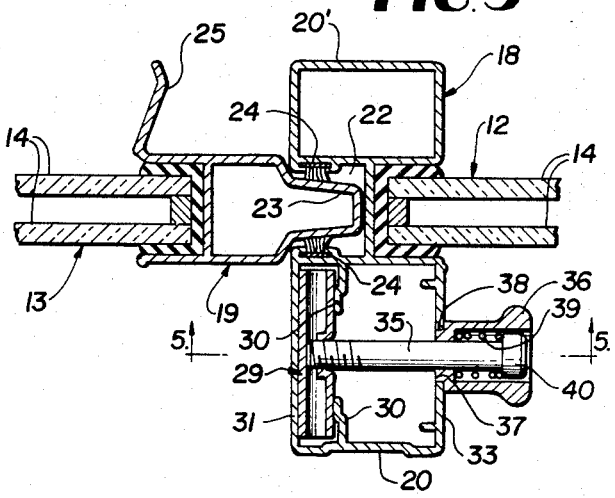
FIG. 4
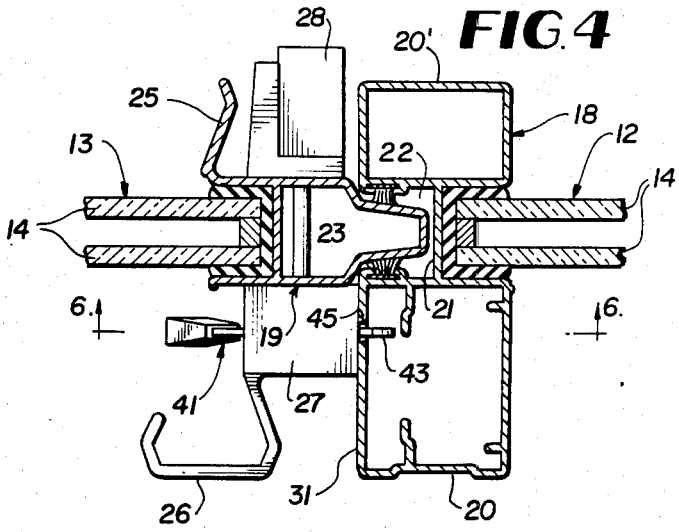

LOCKING ARRANGEMENT FOR SLIDING DOORS

BACKGROUND OF THE INVENTION

This invention relates to an improved locking means for horizontally sliding doors of the type commonly used for allowing access to patios and the like. In particular, the invention relates to four-panel sliding doors which include two fixed end panels and two center sliding panels. Such four-panel sliding doors heretofore have not been deemed very efficient from a security and strength standpoint and in terms of their ability to exclude the elements. This deficiency is due mainly to the unavailability of any adequate and sufficiently economical locking means to join together the meeting vertical stiles of the two sliding center door panels. The principal objective of this invention, therefore, is to completely satisfy this need for a better joining and locking means for the two center sliding panels of four-panel doors, thereby enabling such doors to possess adequate stability in all directions and to have adequate resistance to penetration by the elements when closed and locked.

Briefly stated, the objective of the invention is achieved by the provision within the opposing vertical tongue and groove interfitting stiles of the center sliding panels of the door of two separate cooperating locking devices which effectively secure the sliding panels in closed and locked positions with strength and stability against external forces exerted in any direction. The two separate locking devices are placed at a location where tongue and grooved portions of the meeting vertical stiles interfit, thus offering a maximum resistance to horizontal displacement of the sliding panels while avoiding any tendency for the sliding panels to torque and bind in their trackways, as may tend to occur when locking means are eccentrically located or remote from the plane of interengagement of the tongue and groove portions of the sliding panels.

According to the invention, one of the aforementioned locking devices consists of a vertical axis sliding bolts within the vertical stile of the usually inactive sliding panel immediately adjacent to the groove of the stile which receives the tongue of the stile on the active sliding door panel. The other locking device consists of a lever operated swinging latch bolt built into the vertical stile of the active sliding door panel also closely adjacent to the interfitting tongue and groove portions of the two sliding panels. The latter swinging latch bolt is employed in conjunction with an adjacent rigid anti-lift tab in the active sliding panel which enters a slot provided in the stile of the opposing inactive sliding panel. The arrangement is extremely efficient in achieving the stated objective of the invention, and in greatly improving the operational efficiency, convenience and overall security of four-panel sliding doors, thereby rendering the same much more practical and more carefree in use.

Other features and advantages of the invention will become apparent to those skilled in the art during the course of the following detailed description.

BRIEF DESCRIPTION OF THE DRAWINGS

FIG. 1 is an interior side elevation of a four-panel sliding door arrangement with locking means according to the present invention.

FIG. 2 is an enlarged fragmentary interior side elevation of the two center sliding panels of the door showing their two separate locking devices.

FIG. 3 is an enlarged fragmentary horizontal section taken on line 3—3 of FIG. 2.

FIG. 4 is a similar section taken on line 4—4 of FIG. 2.

DETAILED DESCRIPTION

Figure 5:
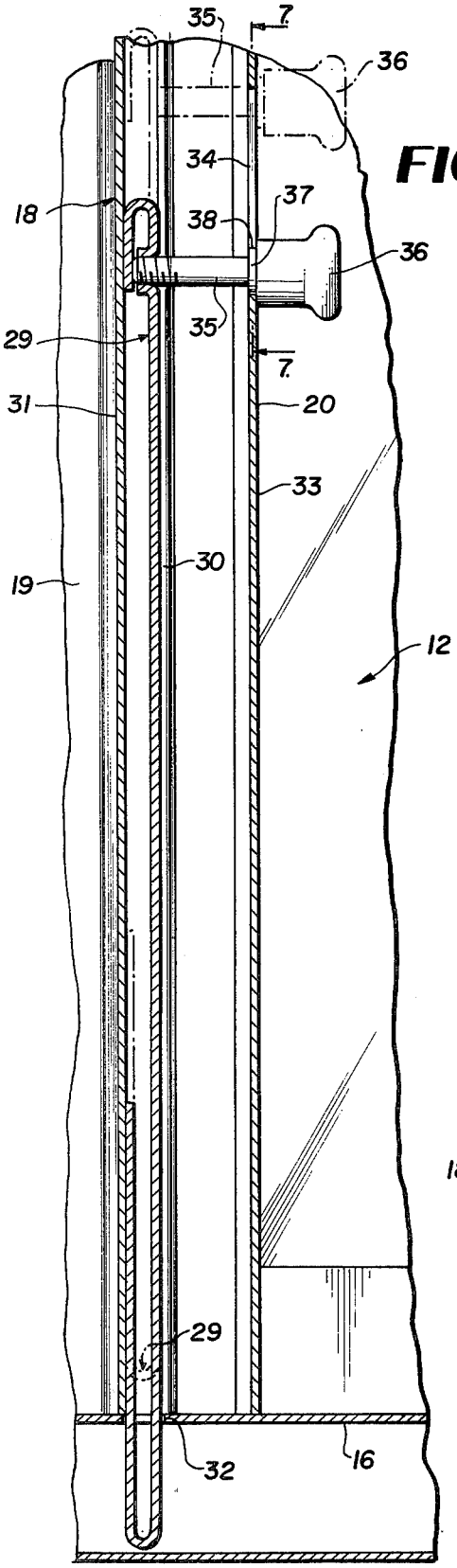
FIG. 5 is a fragmentary vertical section through one locking device taken on line 5—5 of FIG. 3.

Referring to the drawings in detail wherein like numerals designate like parts, a four-panel sliding door structure according to a preferred embodiment of the invention is shown in FIG. 1 including two end fixed door panels 10 and 11 and two center horizontally sliding door panels 12 and 13. The panel 12 is the normally inactive sliding panel whereas the panel 13 is the active sliding panel. However, when both door locking devices according to the invention are released, both of the panels 12 and 13 may slide relative to the fixed panels 10 and 11 and relative to each other.

In general, the sliding door structure may be conventional in that each rectangular panel comprises a dual insulating glass body portion 14, as shown in FIGS. 3 and 4. The glass body portions of the panels are held conventionally in extruded aluminum frames 15 as indicated in FIG. 1. The several framed door panels are engaged in a conventional fixed door frame in which the sliding panels 12 and 13 are movable on conventional horizontal trackways of the frame sill structure 16 and header 17. The two end panels 10 and 11 are fixed in the door frame, as stated.

The meeting vertical stiles 18 and 19 of sliding panels 12 and 13 are configured as shown in FIGS. 3 and 4, and are preferably extruded from aluminum. More particularly, the stile 18 of panel section 12 includes interior and exterior vertical box portions 20 and 20′ separated by an interconnecting web 21, defining on one side thereof a vertical groove 22, adapted to receive a vertical tongue 23 provided on the opposing stile 19 of sliding panel 13. The stile 19 is substantially narrower than the opposing stile 18 due to the fact that it lacks the interior and exterior separated box portions 20 and 20′ of the stile 18. Weather strips 24 are provided on the stile 18 to engage opposite sides of the interfitting tongue 23 when the two sliding panels are closed. The stile 19 carries a flange 25 on its exterior side and an operating handle 26 on its interior side. The handle 26 is joined to an interior swinging bolt housing 27 which in turn is secured by through bolts to an exterior anchor 28 on the far side of the stile 19. Thus far, the described structure is substantially conventional and need not be dealt with in greater detail to enable a proper understanding of the invention.

A first sliding door locking device according to the invention comprises a vertical axis sliding bolt 29 for the normally inactive door panel 12 held within a vertical trackway of the stile box portion 20, said trackway being defined by two spaced aligned flanges 30 in the interior of box portion 20 and the adjacent parallel side wall 31 of the stile 18. As shown in the drawings, the bolt 29 is hollow and of narrow thickness to engage in the narrow guideway. It is comparatively wide at right angles to its thickness dimension to span the interior width of box portion 20 as shown in FIG. 3. The vertically sliding bolt 29 when in a depressed locking position, FIG. 5, has its lower end received in a locking opening 32 of door sill 16 to positively lock the door panel 12 against horizontal movement.

The vertical side wall 33 of stile 18 remote from the side wall 31 has a vertical slot 34 therein receiving slidably the shank 35 of a bolt operating knob 36 having an interior shoulder 37 reduced diameter. This shoulder can engage lockingly in an enlarged circular retainer opening 38 at the lower end of slot 34 and is held therein under influence of a compression spring 39 within a bore of the knob 36 and disposed between the front wall of the knob and an outer end head 40 of the shank 35. The enlarged shoulder 37 is too large to enter and traverse the slot 34. When the shoulder 37 is within the opening 38 under influence of the spring 39, the vertical bolt 29 is locked in the full down position shown in FIG. 5 for locking the inactive sliding panel 12 in the closed position shown in FIG. 1.

In order to release the sliding panel 12, the spring-biased knob 36 is pulled rearwardly against the force of spring 39 to separate the shoulder 37 from retainer opening 38 and outwardly of stile wall 33. The bolt 29 can now be raised to the non-locking position above the sill aperture 32, as shown in broken lines in FIG. 5 by the lifting of the knob 36 while the knob is retracted with its shoulder 37 clear of the opening 38. In such lifting, the shank 35 can pass upwardly through the slot 34, the length of which slot establishes the movement distance of the vertical bolt 29 between its locking and release positions. When the bolt 29 is returned downwardly to the locking position, the shoulder 37 will snap lockingly into the opening 38 under the influence of spring 39.

It will be observed that the body of locking bolt 29, FIG. 3, is immediately adjacent to one side of the stile groove 22 of stile 18 which receives the tongue 23 of stile 19. This close proximity is important and somewhat critical in achieving the stated objectives of the invention, namely, increased strength and stability of the sliding door structure and better resistance to the elements.

The first locking device preferably includes a second vertical axis sliding bolt **29*a* within the top portion of stile 18**, engageable in an aperture provided in the overhead door frame.

Figure 6:
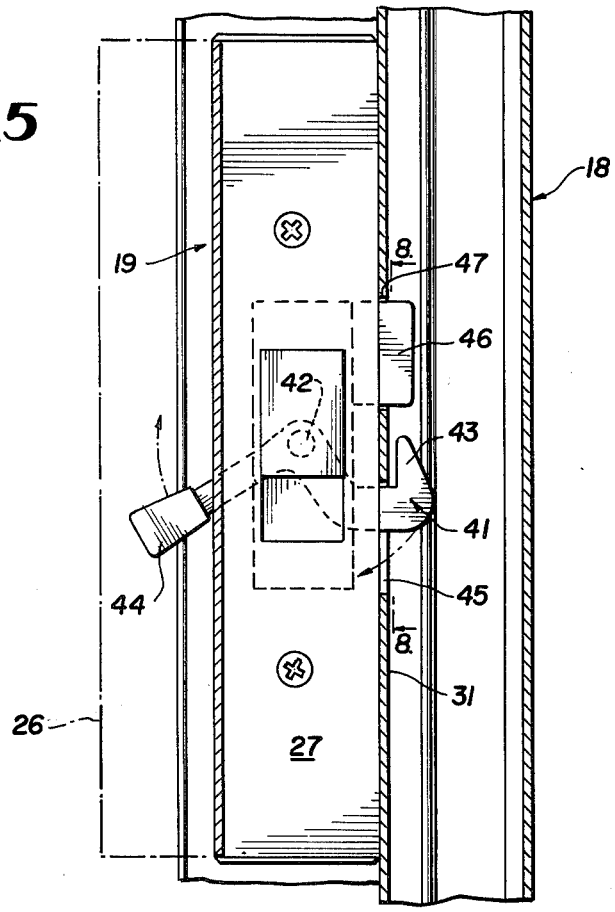
FIG. 6 is a similar view of the other locking device taken on line 6—6 of FIG. 4.
Figure 7:
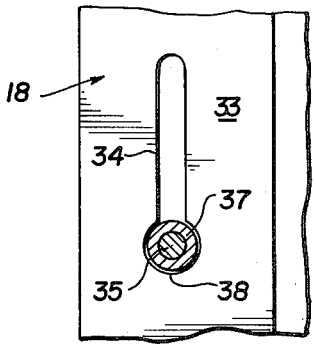
FIG. 7 is a fragmentary vertical section taken on line 7—7 of FIG. 5.
Figure 8:
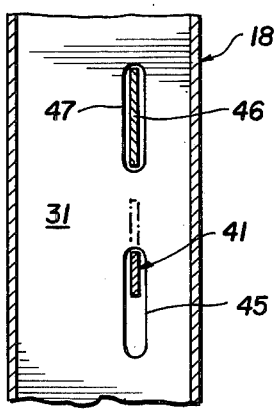
FIG. 8 is a similar section taken on line 8—8 of FIG. 6.

A second locking device according to the invention also required to obtain the above objectives comprises a swinging bolt 41 disposed at an elevation well above the sliding bolt 29 and being mounted on the active sliding door panel 13 to lock the same in secure closed relationship with the inactive sliding panel 12. The swinging bolt 41 is pivotally mounted in the bolt housing 27 on a horizontal pivot axis 42. The bolt 41 includes a hooked locking extension 43 at its forward end and a manual operating lever 44 at its rear end toward the panel 13 and behind the handle 26. The vertically swinging bolt 41 operates through a clearance slot 45 in the housing 27 and in the opposing wall 31 of stile 18. As indicated is FIGS. 6 and 8, the locking extension 43 of swinging bolt 41 engages behind the vertical wall 31 of stile 18 when the bolt is turned on its pivot axis 42 to the locking position through use of the hand lever 44. In such position of the swinging bolt, the door panels 12 and 13 are locked closed with their stiles 18 and 19 interengaged as depicted in FIGS. 3 and 4. To release the swinging bolt 41, the lever 44 is merely elevated and the locking extension 43, FIG. 6, swings downwardly and is able to pass through the slot 45 in the stile wall 31 as the active door panel 13 is slid horizontally to the open position where it overlaps the fixed panel 11.

Immediately above the bolt 41 on the bolt housing 27 is a rigid anti-lift tab 46 which enters another slot 47 of the stile wall 31 when the panels 13 and 12 are in closed relationship. The tab 46 prevents lifting of the sliding panel 13 relative to the panel 12 when the door structure is closed and locked.

As with the vertically sliding bolts 29 and **29*a*, the swinging bolt 41 is located closely adjacent to one side of the tongue and groove interengaging portions of the two opposing stiles 18 and 19, FIG. 4**. As explained previously, this relationship is important in achieving the desired security, stability and overall efficiency in the sliding door structure. The advantages of the invention should now be apparent to those skilled in the art to which the invention relates.

When the invention has been described and illustrated in a four panel sliding door system, its use is not limited to this particular system, and the invention may be utilized in a larger door system having six or more panels. Likewise, the invention may also be utilized in a sliding door system of fewer than four panels, when desired.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A sliding structure comprising at least a pair of opposing horizontally movable door panels engaged with a horizontal trackway, each door panel including a vertical stile, the stile of one door panel having formed therein a vertical groove extending throughout the height of the door panel and the opposing door panel having formed thereon a vertical tongue adapted to enter said vertical groove when the two door panels are in closed stile-to-stile abutting relationship, said vertical groove and tongue being rigid throughout their lengths whereby interengagement of the groove and tongue significantly reinforces the abutting stiles against bending in the outside to inside direction with reference to the door, top and bottom vertical axis sliding bolts contained in the stile having said vertical groove and being disposed closely adjacent to one side of the groove and tongue when the latter are in fully engaged interfitting relationship, a swinging bolt having a horizontal swing axis on the stile of the door panel having said tongue and being disposed at an elevation between said top and bottom sliding bolts and having a hook-like locking extension extending forwardly of the stile on which said swinging bolt is mounted and being received lockingly through a slot provided in the opposing stile having said groove, and the hook-like locking extension when in the active door locking position being disposed closely adjacent to one side of the groove and tongue when the latter are in fully engaged interfitting relationship.

2. A sliding door structure as defined in claim 1, and a rigid anti-lift tongue on the stile having said vertical tongue and said swinging bolt and being disposed at an elevation near the swinging bolt and being adapted to enter a slot provided in the opposing stile having the vertical groove when said stiles are in abutting relationship, said rigid anti-lift tongue also being disposed closely adjacent to one side of said vertical groove and tongue when the latter are fully interengaged and said stiles are in closed abutting relationship.

3. A sliding door structure as defined in claim 1, wherein at least the stile having said vertical groove therein has a hollow box-like compartment extending throughout the height of the stile and said top and bottom vertical axis sliding bolts are held movably and guidably in said compartment.

4. A sliding door structure as defined in claim 3, and operating handle means on said sliding bolts projecting outside of said compartment.

5. A sliding door structure as defined in claim 4, and each handle means including a spring-biased knob having a projection adapted to enter a locating aperture in the adjacent wall of the stile when each sliding bolt is in the active door panel locking position.

* * * * *